US006672851B2

(12) United States Patent
Ito et al.

(10) Patent No.: US 6,672,851 B2
(45) Date of Patent: Jan. 6, 2004

(54) SCROLL-TYPE COMPRESSORS

(75) Inventors: Shigeru Ito, Isesaki (JP); Kiyofumi Ito, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/307,463

(22) Filed: Dec. 2, 2002

(65) Prior Publication Data

US 2003/0108444 A1 Jun. 12, 2003

(30) Foreign Application Priority Data

Dec. 10, 2001 (JP) ..... 2001-375754

(51) Int. Cl.[7] ..... F04C 18/00
(52) U.S. Cl. ..... 418/55.2
(58) Field of Search ..... 418/55.2

(56) References Cited

U.S. PATENT DOCUMENTS

| | | | | |
|---|---|---|---|---|
| 2,324,168 A | | 7/1943 | Montelius | |
| 3,600,114 A | | 8/1971 | Dvorak et al. | |
| 4,457,676 A | | 7/1984 | Hiraga | |
| 4,594,061 A | | 6/1986 | Terauchi | |
| 4,696,084 A | * | 9/1987 | Hirano et al. | 29/888.022 |
| 5,059,102 A | * | 10/1991 | Tokumitsu et al. | 418/55.2 |
| 5,791,886 A | | 8/1998 | Kikuchi et al. | |
| 5,944,500 A | * | 8/1999 | Iizuka | 418/55.2 |
| 6,074,185 A | | 6/2000 | Protos | |

FOREIGN PATENT DOCUMENTS

| | | | | |
|---|---|---|---|---|
| JP | 59058187 | | 4/1984 | |
| JP | 59058187 A | * | 4/1984 | F04C/18/02 |
| JP | 63201385 A | * | 8/1988 | F04C/18/02 |
| JP | 01130083 A | * | 5/1989 | F04C/18/02 |
| JP | 07077178 | | 3/1995 | |
| JP | 10068392 A | * | 3/1998 | F04C/18/02 |

* cited by examiner

*Primary Examiner*—Thomas Denion
*Assistant Examiner*—Theresa Trieu
(74) *Attorney, Agent, or Firm*—Baker Botts L.L.P.

(57) ABSTRACT

A scroll-type compressor includes a fixed scroll member having a first spiral element, and an orbiting scroll member having a second spiral element. The first spiral element and the second spiral element interfit with each other at an angular offset and at a radial offset to form a plurality of fluid pockets which, are adapted to compress a fluid. Further, the first spiral element or the second spiral element, or both, include an interior wall surface defined by a first involute curve based on a circle, an exterior wall surface defined by a second involute curve based on the circle, an end wall surface formed at a center end of the spiral element by a first arc, and a fillet formed along a root of the end wall surface. Moreover, apportion of the fillet is formed by a second arc, and a line which is tangent to the circle and intersects the second involute curve includes a center of curvature of the first arc and a center of a curvature of the second arc.

6 Claims, 5 Drawing Sheets

SCROLL-TYPE COMPRESSORS

BACKGROUND OF THE INVENTION

1. Field of the Invention

The present invention relates generally to scroll-type compressors. In particular, the invention is directed to scroll-type compressors having spiral elements which reduce or suppress a noise associated with an expansion of a compressed refrigerant.

2. Description of Related Art

Referring to FIG. 4, a known scroll-type compressor 100, such as the compressor described in Japanese Patent (unexamined) Publication No. H7-77178, may include a compressor housing 101, and housing 101 may include a fixed scroll member 103 and an orbiting scroll member 105. Fixed scroll member 103 may have a first spiral element 102, and orbiting scroll member 105 may have a second spiral element 104. Fixed scroll-member 103 and orbiting scroll member 105 are positioned inside housing 101, such that first spiral element 102 and second spiral element 104 interfit with each other and form a plurality of fluid pockets 106. Compressor 100 also may include a discharge port 109 formed through about a center of a first end plate of fixed scroll member 103 and a drive shaft 107 which is positioned inside housing 101 and is rotatably supported, by housing 101 via a bearing 120. Drive shaft 107 also may be connected to orbiting scroll member 105 via a crank mechanism 108. Compressor 100 further may include a rotation prevention mechanism 121, and rotation prevention mechanism 121 may include a plurality of balls 130. Each of balls 130 is positioned between a surface of a second end plate of orbiting scroll member 105 and an axial end surface of housing 101. Moreover, rotation prevention mechanism 121 is adapted to prevent orbiting scroll member 105 from rotating. Rotation prevention mechanism 121 also is adapted to allow orbiting scroll member 105 to move in an orbital motion with respect to a center of fixed scroll member 103. Compressor 100 also may include an electromagnetic clutch 122 which is rotatably supported by housing 101 via a bearing 123.

In operation, when an external power source, e.g., an engine of a vehicle, transfers a driving force to drive shaft 107 via electromagnetic clutch 122, drives shaft 107 rotates. Because drive shaft 107 is connected to orbiting scroll member 105 via crank mechanism 108, when drive shaft 107 rotates, drive shaft 107 drives orbiting scroll member 105 to move in an orbital motion. Moreover, when orbiting scroll member 105 moves in the orbital motion, fluid pockets 106 also may move from outer portions of first spiral element 102 and second spiral element 104 to a center portion of first spiral element 102 and second spiral element 104. Consequently the volume of fluid pockets 106 is reduced, and refrigerant gas, which is in fluid pockets 106, is compressed. After the refrigerant gas is compressed in the center portion of the spiral elements, the refrigerant gas moves through discharge port 109, displaces a reed value 124, and is discharged into an external refrigerant circuit (not shown) via an outlet port (not shown).

Referring to FIGS. 5*a*–5*c,* a compression stroke and a discharge stroke of compressor 100 is depicted. Specifically, referring to FIG. 5*a*, fluid pockets 106 may include a first fluid pocket portion 106*a* and a second fluid pocket portion 106*a*. During the compression stroke, fluid pocket portions 106*a* and 106*a* may move towards the center portion of first spiral element 102 and second spiral element 104, such that a volume of the fluid pocket portions 106*a* and 106*a* is reduced. Subsequently, as shown in FIG. 5*b,* fluid pocket portions 106*a* and 106*a* may merge and become a combined fluid pocket 206 located at the center portion of spiral element 102 and spiral element 104. First fluid pocket portion 106*a* may be scaled at a first pair of seal points a and b, and second fluid pocket portion 106*a*, may be sealed at a second pair of seal points a and b. Moreover, combined-fluid pocket 206 may be seal points a and a. As shown in FIG. 5*c,* as fluid pocket portions 106*a* and 106*a*' merge into combined fluid pocket 206, seal points b and b move towards the center of first spiral element 102 and second spiral element 104, and seal points a and a disappear.

Referring to FIG. 7, one of the examples of a center portion of a spiral element of a known scroll member, a plan view of a spiral element 102 (104), is depicted. A center of a curvature 112 of an arc 111 at a tip portion of spiral element 102 (104) is positioned on a line from an involute 115. A center of a curvature 114 of an arc 113 of a fillet is positioned on a line from an involute 116. A base circle 117 is for making involute 115 and involute 116. The center of curvature 112 and the center of curvature 114 are positioned on a different line of an involute, in other words, on a different involute angle.

Referring to FIG. 6, a fillet 110 may be formed at a base of a wall at a center end portion of first spiral element 102 and second spiral element 104. Fillet 110 may be adapted to reinforce the wall at the center portion of first spiral element 102 and second spiral element 104 at which the pressure of the refrigerant gas is greatest. Moreover, because fillet 110 is formed at the root of the wall at the center end portion of first spiral element 102 and second spiral element 104, the wall at the center end portion of first spiral element 102 does not contact the wall at the center end portion of second spiral element 104. Consequently, as orbiting scroll 105 orbits, seal points a and a disappear, and fillet 110 creates a first space between first spiral element 102 and second spiral element 104 and a second space between first spiral element 102 and second spiral element 104. Combined fluid pocket 206 may be in fluid communication with first fluid pocket portion 106*a* and second fluid pocket portion 106' via the first space and the second space, respectively, and compressed refrigerant may flow from combined fluid pocket 206 to first fluid pocket portion 106*a* and second fluid pocket portion 106*a*'. When the compressed refrigerant flows into first fluid pocket portion 106*a* and second fluid pocket portion 106*a*', the compressed refrigerant may expand rapidly, which may generate noise.

In order to suppress this noise, in known compressors, each of the scroll members may, include a communication portion, e.g., a notch, a groove, an aperture, or the like, formed adjacent to each of the seal points. Moreover, the communication portion is adapted to relieve pressure from combined fluid pocket 206 and, thereby to suppress the noise associated with the expansion of the refrigerant. Nevertheless, when the refrigerant expands, a portion of the refrigerant flows to an adjacent fluid pocket via the communication portion, which may decrease compression efficiency.

SUMMARY OF THE INVENTION

Therefore, a need has arisen for scroll-type compressors which overcome these and other shortcomings of the related art. A technical advantage of the present invention is that noise associated with the expansion of compressed fluid is reduced.

In an embodiment of the present invention, a scroll-type compressor includes a fixed scroll member having a first spiral element, and an orbiting scroll member having a second spiral element. The first spiral element and thee second spiral element interfit with each other at an angular offset and at a radial offset to form a plurality of fluid pockets which are adapted to compress a fluid. Further, the first spiral element or the second spiral element, or both, include an interior wall surface defined by a first involute curve based on a circle, an exterior wall surface defined by a second involute curve based on the circle, an end wall surface formed at a center end of the spiral element by a first arc, and a fillet formed along a root of the end wall surface. Moreover, a portion, of the fillet is formed by a second arc, and a line which is tangent to the circle and intersects the second involute curve includes a center of curvature of the first arc and a center of a curvature of the second arc.

In another embodiment of the present invention, a scroll-type compressor includes a fixed scroll member having a first spiral element, and an orbiting scroll member having a second spiral element. The first spiral element and the second spiral element interfit with each other at an angular offset and at a radial offset to form a plurality of fluid pockets which arc adapted to compress a fluid. Further, the first spiral element or the second spiral element, or both, include an interior wall surface defined by a first involute curve based on a circle having a radius of about 3.5 mm, an exterior wall surface defined by a second involute curve based on the same circle as the interior wall surface, an end wall surface formed at a center end of the spiral element by a first arc having a first length of about 3.5 mm, and a fillet formed along a root of the end wall surface. Moreover a portion of the fillet is formed by a second arc having a second length of about 4.0 mm, and a center of curvature of the first arc and a center of a curvature of the second arc are positioned on the second involute curve. Further, a counterclockwise angle formed between a center of curvature of the circle and a plane including the center of curvature of the first arc and the center of curvature of the second arc is about 150°.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, the needs satisfied thereby, and the objects, features and advantages thereof, reference now is made to the following description taken in connection with the accompanying drawings.

DETAILED DESCRIPTION OF PREFERRED EMBODIMENTS

Figure 1:
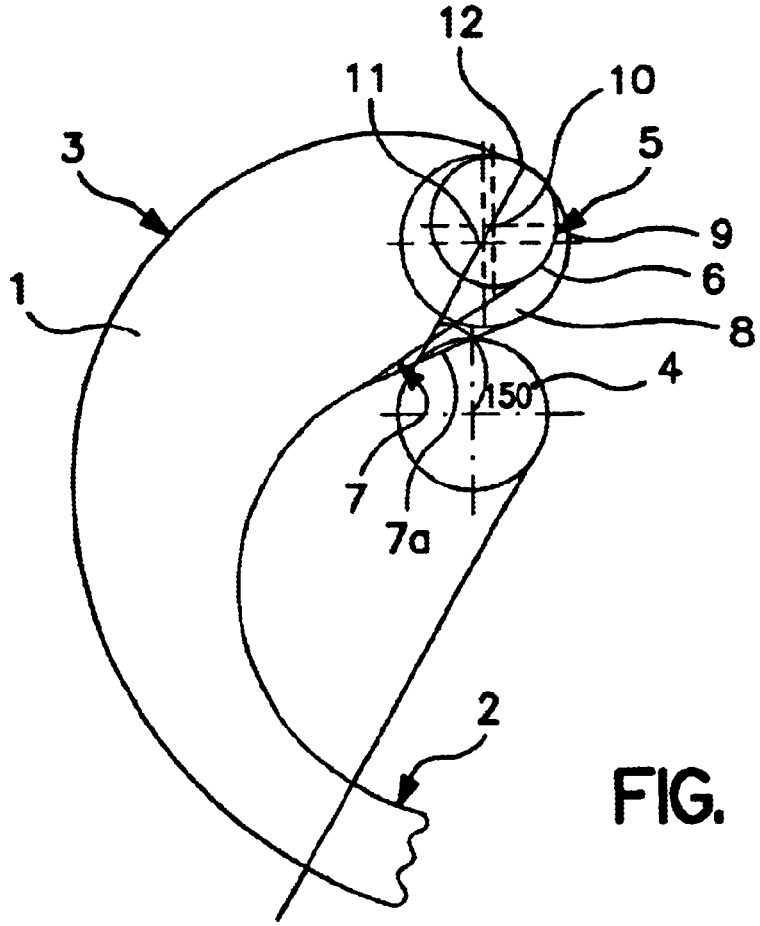
FIG. 1 is a partial, plan view of a spiral element of a scroll-type compressor according, to a first embodiment of the present invention.
Figure 2A:
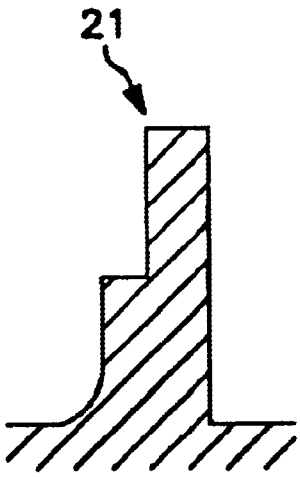
FIG. 2*a* is a cross-section view of a spiral element of a scroll-type compressor according to a second embodiment of the present invention.
Figure 2B:
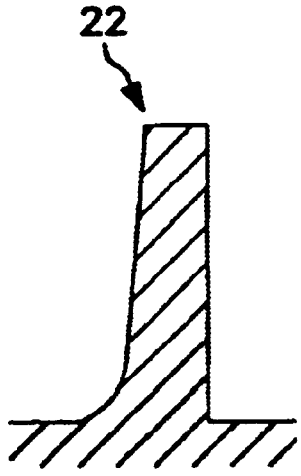
FIG. 2*b* is a cross-sectional view of a spiral element of a scroll-type compressor according, to a third embodiment of the present invention.
Figure 3:
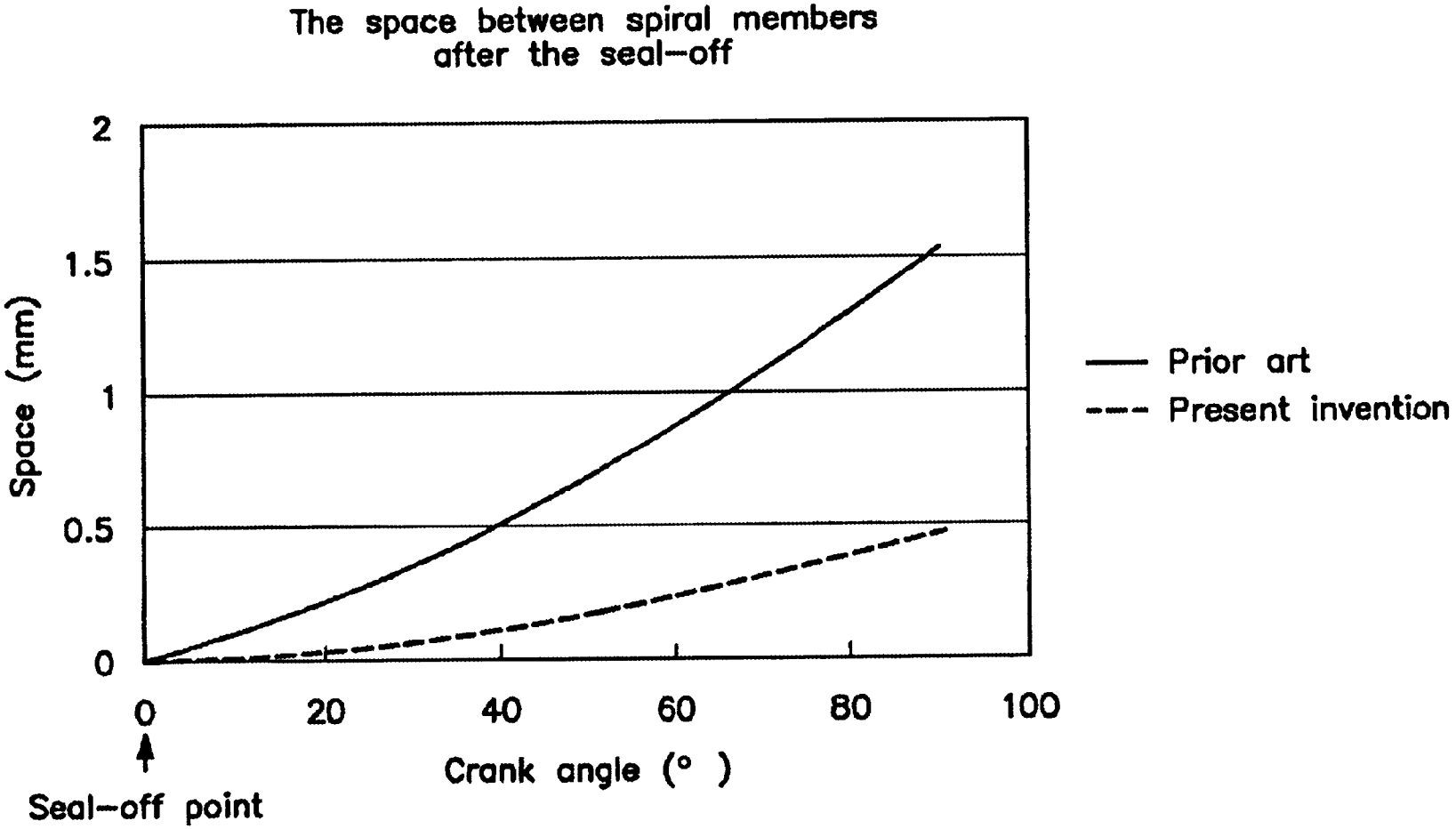
FIG. 3 is a chart depicting the relationship between a space between the spiral elements and a crank angle, according to an embodiment of the present invention and known scroll compressor.
Figure 4:
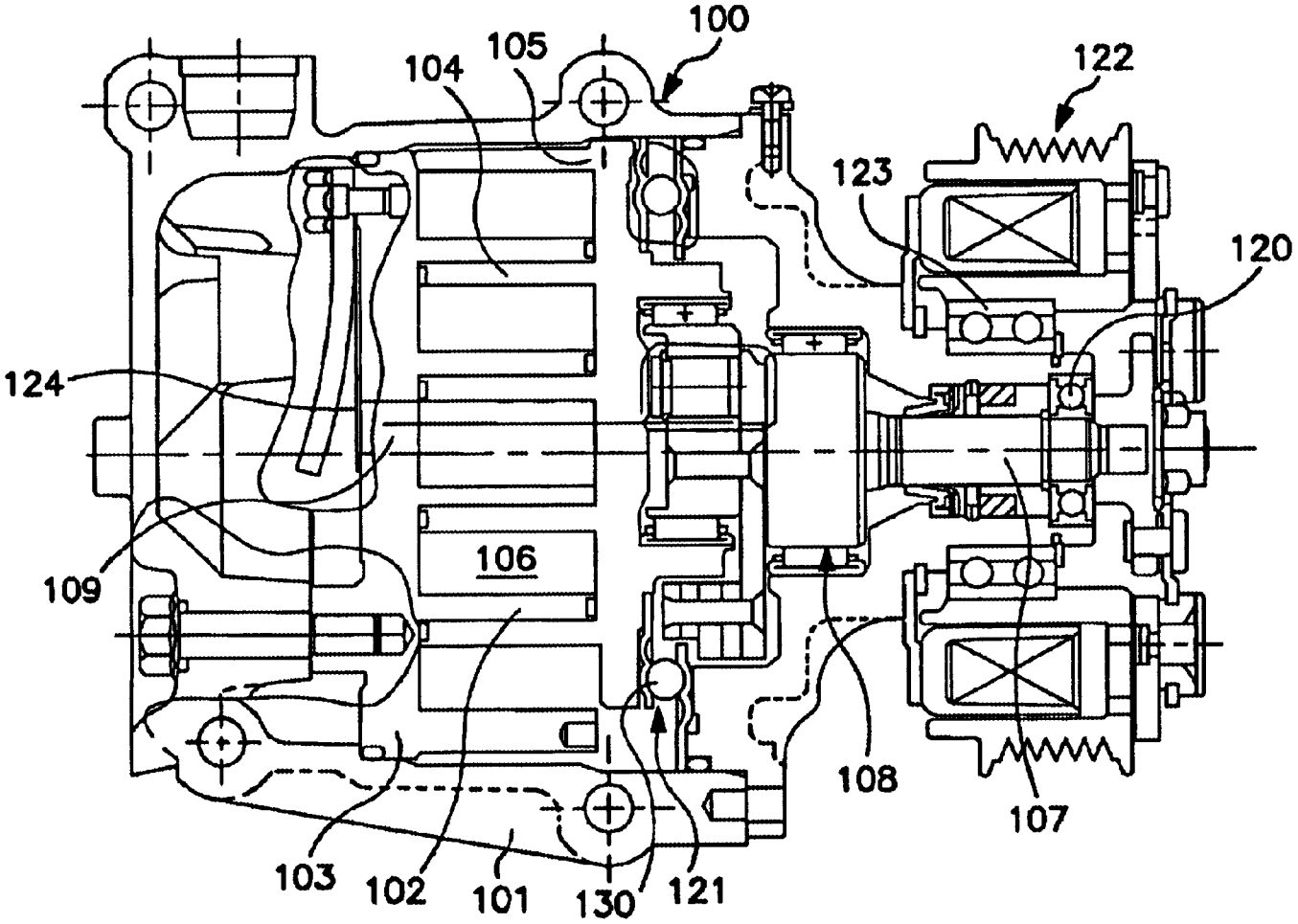
FIG. 4 PRIOR ART
FIG. 4 is a longitudinal, cross-sectional view of a known scroll-type compressor.
Figure 5A:
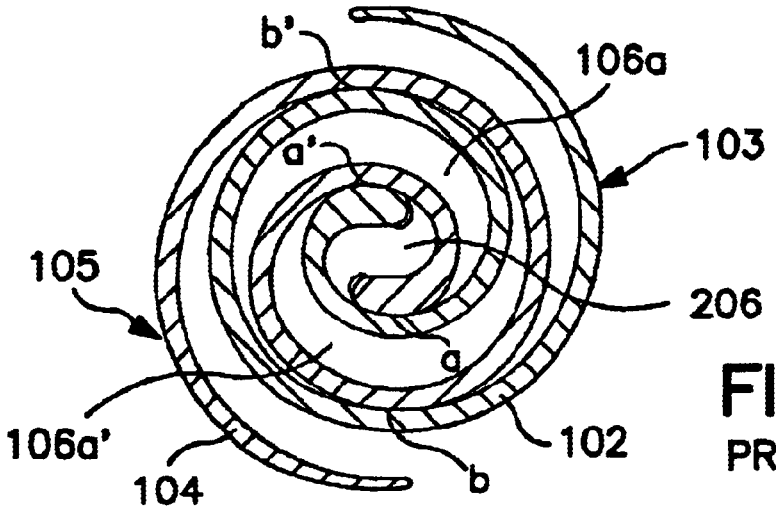
FIG. 5a PRIOR ART
FIGS. 5*a–c* are cross-sectional views depicting a compression and a discharge stroke of the known scroll-type compressor.
Figure 5B:
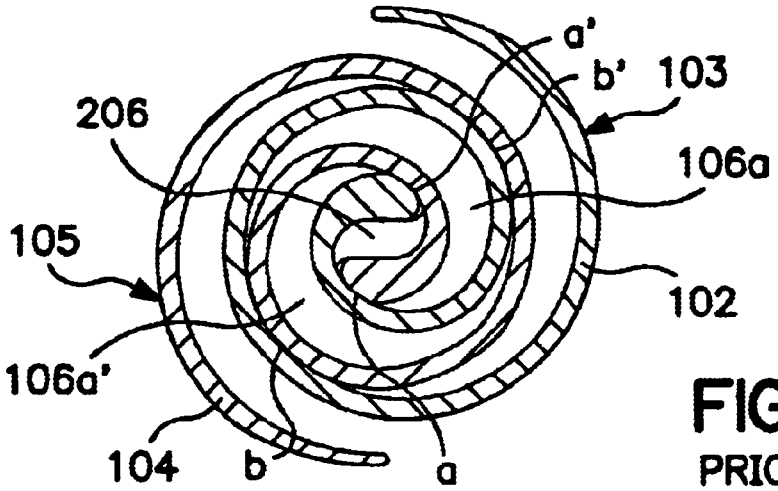
FIG. 5b PRIOR ART
Figure 5C:
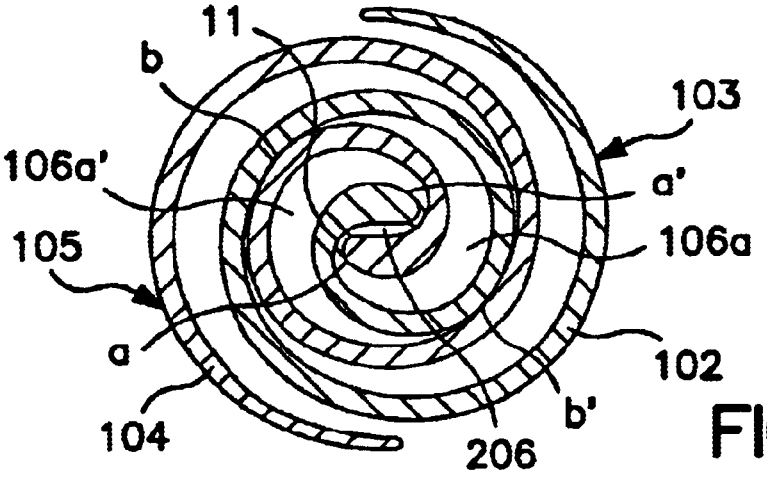
FIG. 5c PRIOR ART
Figure 6:
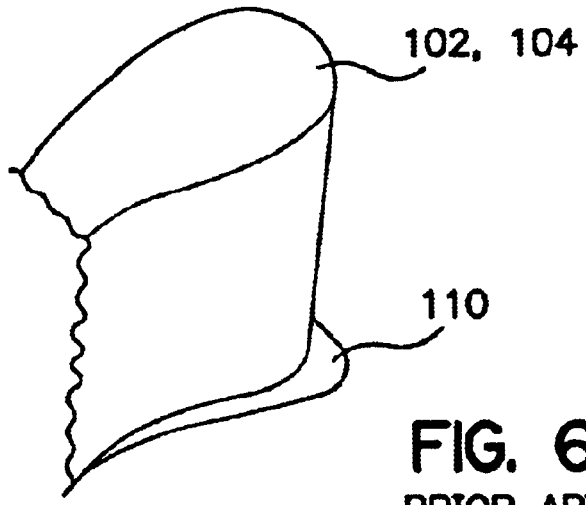
FIG. 6 PRIOR ART
FIG. 6 is a partial, perspective view of a spiral element of the known scroll-type compressor.
Figure 7:
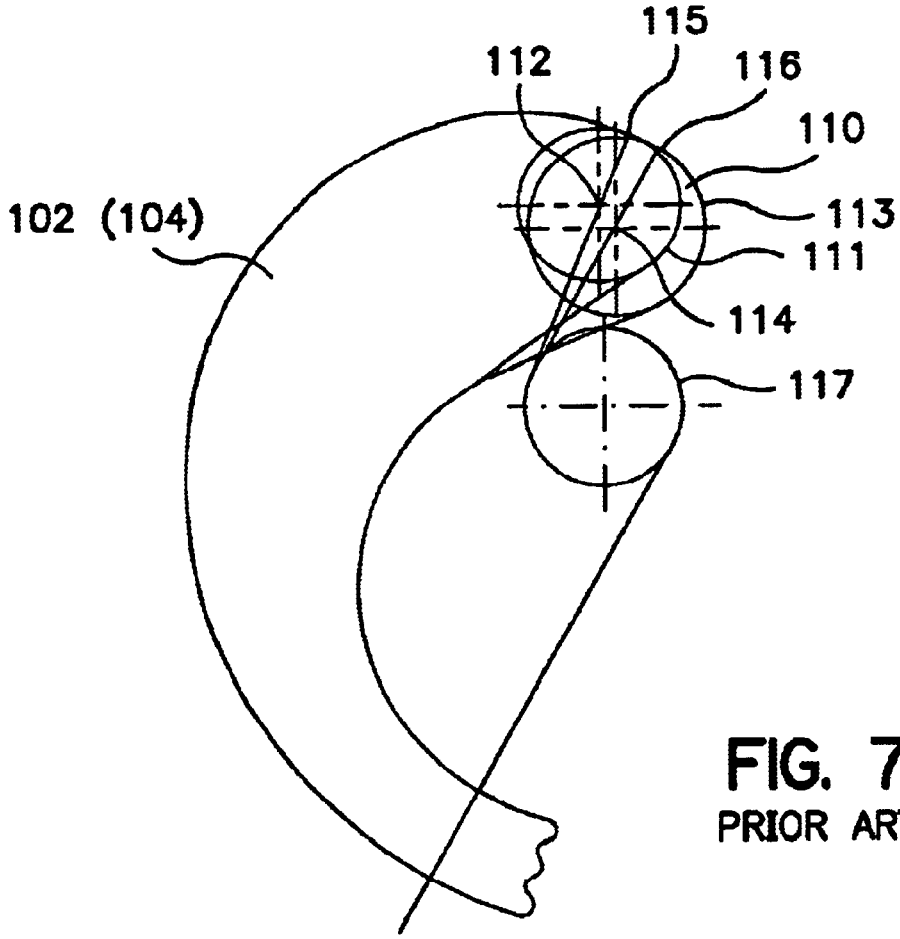
FIG. 7 PRIOR ART
FIG. 7 is a partial, plan view of the spiral element of the known scroll-type compressor.

Preferred embodiments of the present invention and their advantages may be understood by referring to FIGS. 1–3, like numerals being used for corresponding parts in the various drawings.

Referring to FIG. 1, a portion of a spiral-element 1 of a scroll-type compressor, according to the first embodiment of the present invention, is depicted. Spiral element 1 may be formed on an end plate of a fixed scroll member or on an end plate of an orbiting scroll member. Spiral element 1 may have an interior wall surface 2, an exterior wall surface 3, and an end wall surface 5. Each interior wall surface 2 and each exterior wall surface 3 may be defined or circumscribed by an involute curve based on a base circle 4. Moreover, end wall surface 5 may be formed at a center end of spiral element 1 along an arc 6. Arc 6 and an arc connected to the involute staring point of interior wall surface 2 may be connected by a straight line 7. Further, a fillet 8 may be formed at and along a root of end wall surface 5, and an exterior peripheral shape of a portion of fillet 8 may be formed by an arc 9 in a plane direction of spiral element 1. Arc 9 and the arc connected to the involute starting point of interior wall surface 2 may be connected by a straight line portion 7*a* of fillet 8.

In the first embodiment of the present invention, a center of curvature 10 of arc 6, and a center of curvature 11 of arc 9, are positioned on an line 12. Line 12 may be tangent to base circle 4 and may intersect exterior wall surface. Line 12 also may be used to create exterior wall surface 3. In this embodiment, a wall of spiral element 1 may have a substantial rectangular cross-section. Nevertheless, referring to FIG. 2*a,* in a second embodiment, the wall of spiral element 1 may have a step-shaped cross-section 21. Similarly, referring to FIG. 2*b,* the wall of spiral element 1 may have cross-section shape 22 which continuously changes.

As shown in FIG. 1, center of curvature 10 of arc 6 and center of curvature 11 of arc 9 may be positioned on line 12. Consequently, when the scroll members are sealed off, a space between a first fluid pocket and an adjacent, second fluid pocket may be less than in the known compressor 100. As such, a speed with which compressed fluid flows from the first fluid pocket to the second fluid pocket may be less than in the known compressor 100. As a result, noise associated with expansion of the compressed fluid may decrease.

For example, according to an exemplary embodiment of the present invention, a radius of base circle 4 is about 3.5 mm; a length of arc 6 is about 3.5 mm; a length of arc 9 is about 4.0 mm; and center of curvature 10 of arc 6 and center of curvature 11 of arc 9 are positioned on the same line 12 having a relative involute angle of about 150°.

In contrast, in the known compressor 100, a radius of a base circle 4 is about 3.5 mm; a length of arc 6 is about 3.5 mm; a length, of arc 9 is about 4.0 mm; a center of curvature of arc 6 is positioned on an involute having a relative involute angle of about 158°; and a center of curvature of arc 9 is positioned on an involute having a relative involute angle of about 150°.

With respect to the above-described example, FIG. 3 depicts a relationship between a crank angle of the crank mechanism, and a space between the spiral elements after the spiral elements are sealed off. As shown in FIG. 3, in the above-described example, the space between the spiral elements is less than that of the known compressor 100, which reduces noise associated with the expansion of the compressed fluid.

While the invention has been described in connection with preferred embodiments, it will be understood by those skilled in the art that other variations and modifications of the preferred embodiments described above may be made without departing from the scope of the invention. Other embodiments will be apparent to those skilled in the art from a consideration of the specification or practice of the invention disclosed herein. It is intended that the specification and described examples are considered exemplary only, with the time scope and spirit of the invention indicated by the following claims.

What is claimed is:

1. A scroll-type compressor, comprising:

a fixed scroll member having a first spiral element; and an orbiting scroll member having a second spiral element, wherein the first spiral element and the second spiral element interfit with each other at an angular offset and at a radial offset to form at least one pair of fluid pockets which are adapted to compress a fluid, wherein at least one spiral element selected from the group consisting of the first spiral element and the second spiral element comprises:

an interior wall surface defined by a first involute curve based on a circle;

an exterior wall surface defined by a second involute curve based on the same circle as the interior wall surface;

an end wall surface formed at a center end of the spiral element by a first arc; and a fillet formed along a root of the end wall surface, wherein at least a portion of the fillet is formed by a second arc, and wherein a line which is tangent to the circle and intersects the second involute curve includes a center of curvature of the first arc and a center of a curvature of the second arc.

2. The scroll-type compressor of claim 1, wherein the first spiral element and the second spiral element have a step-shape in cross-section.

3. The scroll-type compressor of claim 1, wherein the first spiral element and the second spiral element have a tapered shape in cross section.

4. A scroll-type compressor, comprising:

a fixed scroll member having a first spiral element; and an orbiting scroll member having a second spiral element, wherein the first spiral element and the second spiral element interfit with each other at an angular offset and at a radial offset to form at least one pair of fluid pockets which are adapted to compress a fluid, wherein at least one spiral element selected from the group consisting of the first spiral element and the second spiral element comprises:

an interior wall surface defined by a first involute curve based on a circle having a radius of about 3.5 mm;

an exterior wall surface defined by a second involute curve based on the same circle as the interior wall surface;

an end wall surface formed at a center end of the spiral element by a first arc having a first length of about 3.5 mm; and a fillet formed along a root of the end wall surface, wherein at least a portion of the fillet is formed by a second arc having a second length of about 4.0 mm, wherein a line which is tangent to the circle and intersects the second involute curve includes a center of curvature of the first arc and a center of a curvature of the second arc, and wherein a counter-clockwise angle formed between a center of curvature of the circle and a plane including the center of curvature of the first arc and the center of curvature of the second arc is about 150°.

5. The scroll-type compressor of claim 4, wherein the first spiral element and the second spiral element have a step-shape in cross-section.

6. The scroll-type compressor of claim 4, wherein the first spiral element and the second spiral element have a tapered shape in cross section.

* * * * *